United States Patent [19]

Bynoe

[11] Patent Number: 4,492,064

[45] Date of Patent: Jan. 8, 1985

[54] INSULATED ROOF CONSTRUCTION

[75] Inventor: Robert J. Bynoe, Chagrin Falls, Ohio

[73] Assignee: The B. F. Goodrich Company, New York, N.Y.

[21] Appl. No.: 329,843

[22] Filed: Dec. 11, 1981

[51] Int. Cl.[3] ..... E04B 5/00

[52] U.S. Cl. ..... 52/309.8; 52/408

[58] Field of Search ..... 52/408, 410, 411, 199, 52/95, 309.8, 309.9, 309.11

[56] References Cited

U.S. PATENT DOCUMENTS

| | | | |
|---|---|---|---|
| 3,266,206 | 8/1966 | Cosby | 52/309.9 |
| 3,282,008 | 11/1966 | Sheahan | 52/309.9 |
| 3,411,256 | 11/1968 | Best | 52/408 |
| 3,466,825 | 9/1969 | Gaddal | 52/408 |
| 3,694,306 | 9/1972 | Fricklas | 52/408 |
| 3,817,009 | 6/1974 | Elder | 52/199 |
| 4,272,936 | 6/1981 | Bonaguidi | 52/408 |
| 4,274,238 | 6/1981 | O'Riordain | 52/309.9 |
| 4,397,126 | 8/1983 | Nelson | 52/408 |

FOREIGN PATENT DOCUMENTS

| | | | |
|---|---|---|---|
| 753715 | 7/1970 | Belgium | 52/408 |
| 1816577 | 6/1970 | Fed. Rep. of Germany | 52/199 |
| 2465042 | 9/1980 | France | 52/408 |
| 775258 | 10/1980 | U.S.S.R. | 52/199 |

*Primary Examiner*—Henry E. Raduazo

*Attorney, Agent, or Firm*—James R. Lindsay; Woodrow W. Ban

[57] ABSTRACT

A built-up insulated roof construction is provided that includes panels of closed-cell thermal insulation foam disposed over a water-impermeable barrier layer. A protective layer is applied over the panels of thermal insulation foam. The upper face of the insulation panels contains grooves or channels to aid in the evaporation of moisture through the insulation panels to the outside atmosphere.

11 Claims, 5 Drawing Figures

FIG. 1
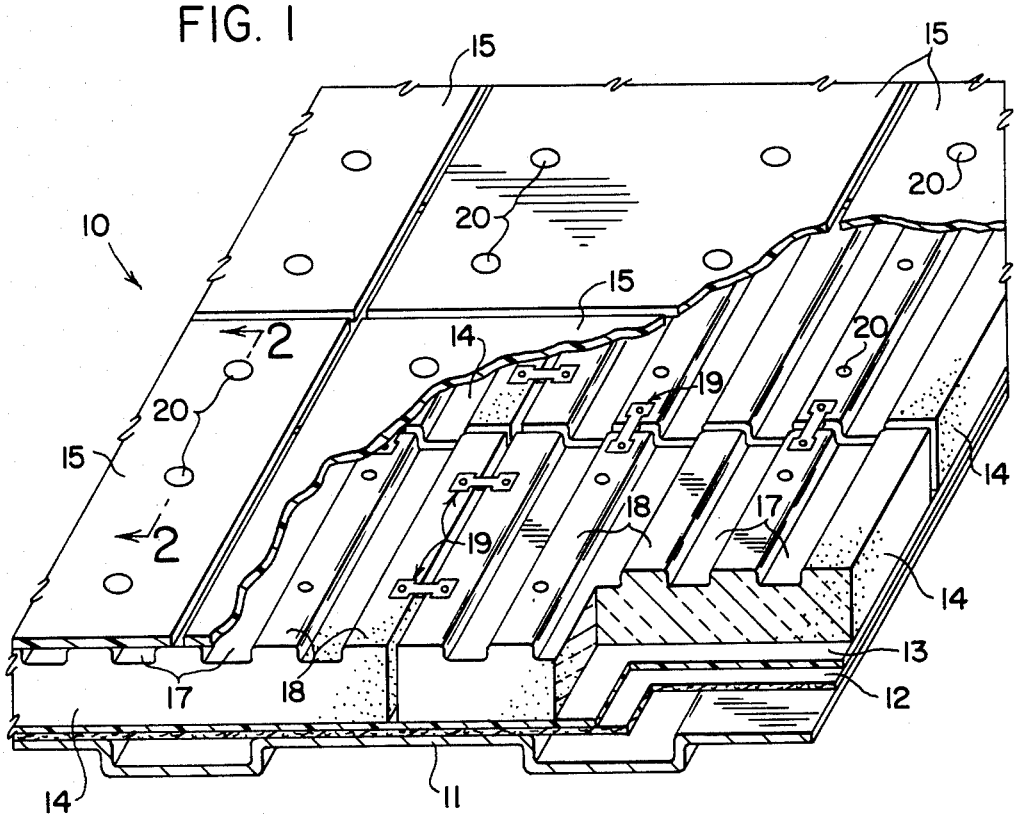
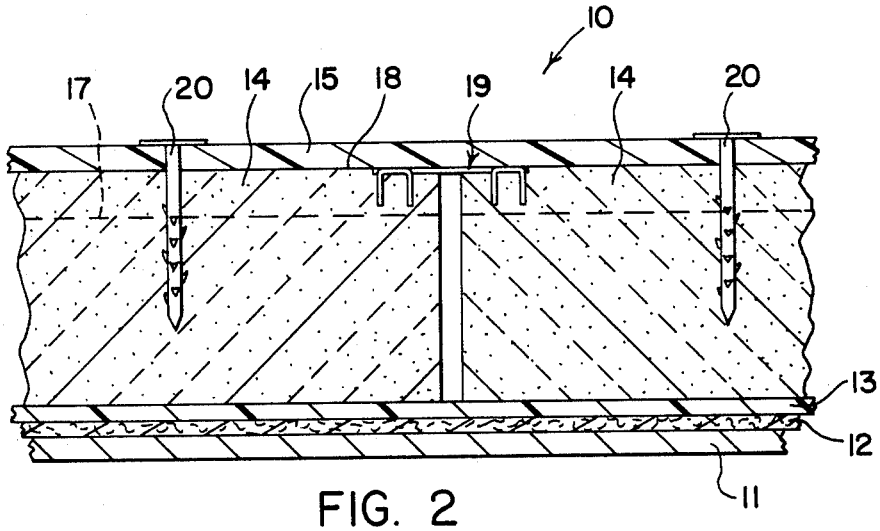
FIG. 2

FIG. 3
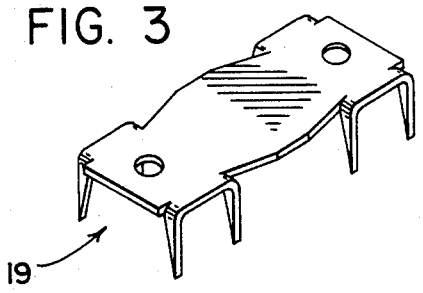
FIG. 4
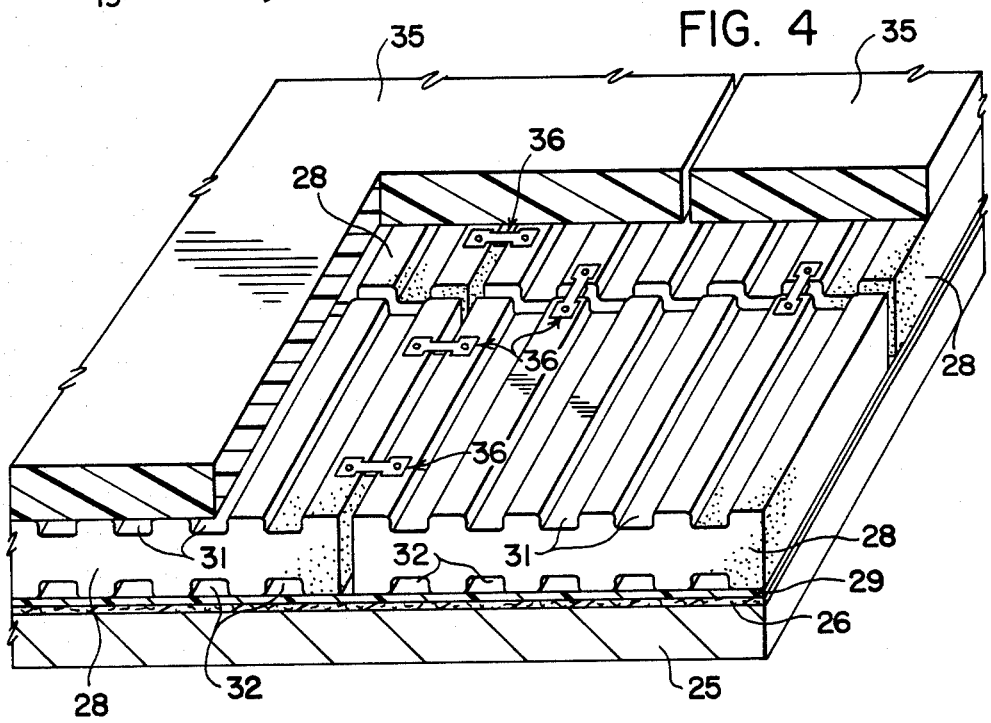
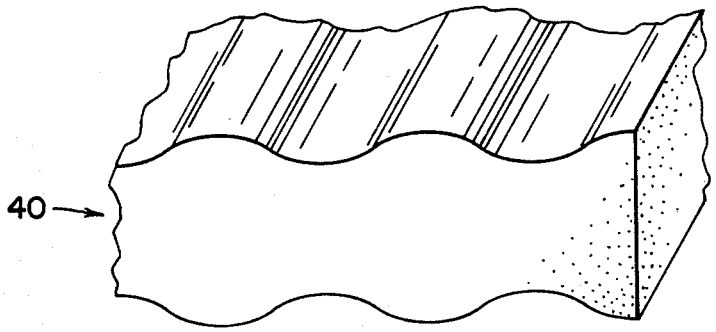
FIG. 5

INSULATED ROOF CONSTRUCTION

BACKGROUND OF THE INVENTION

A conventional built-up roof structure utilizes a water-impermeable roofing layer disposed over and supported by a roof deck which may consist of a corrugated steel deck supported by structural I-beams or a structural plywood or composite board base supported on top of wooden or steel beams. Usually the water-impermeable layer consists of several layers of felt laminated together with coatings of bitumen. A protective layer of gravel generally is deposited over the water-impermeable layer to hold the water-impermeable layer in place. In geographical regions in which the roof is subjected to significant climatic temperature variations, it often is desirable that the roof be provided with insulation to reduce loss of heat through the roof when the ambient outside temperature drops and to reduce heat penetration through the roof to the interior of the building when the ambient temperature outside of the building appreciably exceeds the normal temperature within the building.

In U.S. Pat. No. 3,411,256, a built-up insulated roof construction is shown that includes flat panels of closed-cell thermal insulation foam adhered to the upper face of a water-impermeable membrane (usually formed of alternating layers of felt and bituminous material, although sheets of water-impermeable plastic may also be used). A protective layer of gravel is spread over the insulation panels to protect the insulation foam from UV (ultraviolet radiation) degradation and to aid in preventing the panels from being dislodged by winds. If desired, a fire-resistant layer is interposed between the roof deck and the water-impermeable membrane (such as described in U.S. Pat. No. 3,763,614) to provide a degree of fire protection for the roof structure in the event of fire.

Although the water-impermeable barrier layer and thermal insulation layer of the above-described built-up roof constructions are impervious to water, the materials from which these layers are formed allow moisture (water vapor) to penetrate into and through the layers. The ability of moisture to move through the water-impermeable barrier layer and the thermal insulation layer of the roof structure is desirable to reduce problems associated with moisture build-up within the roofing system, particularly when the ambient outside temperature is significantly below the temperature at the interface of the insulation layer and the water-impermeable barrier layer.

It will be appreciated that during a rain or as snow or ice melts on the built-up roof during a thaw, a film of water will form on the flat upper surface of the insulation panels of the roof. The water film interfers with the normal transfer of moisture through the insulation panel by elimination of the normal movement of moisture vapor from the more saturated regions at the bottom of the insulation panel to the less saturated regions at the top of the insulation with resultant evaporation of the moisture into the atmosphere from the panel's upper surface. As a consequence, an objectionable accummulation of moisture within the insulation panel can occur which reduces the thermal insulating properties of the panel. Also, when the temperature of the outside atmosphere drops below freezing, frosting and even freezing of moisture can occur within the insulation panel creating internal stresses within the panel that can in time cause a premature failure of the panel.

SUMMARY OF THE INVENTION

In accordance with the present invention, a built-up roof construction is provided in which water-impermeable thermal insulation panels that have grooves or channels in their upper faces are employed which allow water to flow from the crests or ridges between the grooves or channels, into the grooves or channels and then from the roof system into roof drains. The crests or ridges between the grooves or channels offer surfaces free from water accummulation that provide paths through which moisture within the panels can evaporate into the surrounding atmosphere thereby preventing or at least reducing the tendency for moisture to become entrapped within the panel. The roof construction of the present invention can be used in the initial roofing system for a building or in retrofitting an older building to provide a new insulated roof for the building. The invention will be more fully understood from the following detailed description of roofing systems that embody the invention.

IN THE DRAWINGS

FIG. 1 is a fragmentary perspective view, partly broken away, of a roofing system embodying the present invention;

FIG. 2 is an enlarged sectional view on line 2—2 of FIG. 1,

FIG. 3 is an enlarged perspective view of one of the mechancial clip fasteners shown in FIG. 1 for securing adjacent insulation panels together;

FIG. 4 is a fragmentary perspective view, partly broken away, of a second embodiment of the invention; and FIG. 5 is a fragmentary perspective view illustrating another embodiment of insulation panels useful in the present invention.

DETAILED DESCRIPTION OF THE INVENTION

FIG. 1 of the drawings shows a built-up roof construction 10 comprised of a conventional metal deck 11, (generally made of steel or structural aluminum and supported by I-beams or other appropriate supporting members, not shown) over which is disposed a fire-resistant barrier layer 12, a water-impermeable layer 13 consisting of a non-tacky sheet material overlying layer 12, and panels 14,14 of thermal insulation material positioned in side-by-side abutting relationship overlying layer 13. Panels 14,14 are unsecured to layer 13 allowing the panels 14,14 to move relative to layer 13. A protective cover layer (comprised of panels 15,15 positioned in side-by-side abutting relationship) shields panels 14,14 from the rays of the sun which have a tendency to deteriorate many of the materials from which thermal insulation panels 14,14 normally might be formed.

While it is not necessary to have a fire-resistant barrier layer 12 overlying the metal deck 11, as is explained in U.S. Pat. No. 3,763,614 when the barrier layer 12 is omitted, thermoplastic organic materials in other components of the roof system during a fire may heat-soften and flow and contribute to the spread of the fire. The fire-resistant barrier layer 12 may be comprised of any fire-resistant composition, for example, cement/asbestos board, gypsum board, or panels formed of foamed glass, ceramic foam, thermoset plastic foam (such as phenolic resin foam and epoxy resin foam), or a mixture of gypsum, glass fibers and expanded mica (such as vermiculite). Barrier layer 12 desirably is adhered to deck 11 with a suitable adhesive material or by means of mechanical fasteners. Generally, a layer of fire-retardant material between 0.5 to 3 centimeters thick is utilized to form barrier layer 12.

The water-impermeable layer 13 overlying barrier layer 12 may be formed of any suitable water-impermeable material, including conventional bituminous compositions customarily used for forming water-impermeable roofing layers as well as laminates formed of alternating layers of such bituminous compositions with layers of fibrous materials such as roofing felts or fabrics formed of organic or inorganic fibers. Layer 13 also may be formed of a water-impermeable membrane comprised of a thermoplastic resinous sheet or film (such as a sheet or film of polyethylene, polypropylene, polyvinyl chloride, chlorinated polyethylene, chlorosulfonated polyethylene, and the like) with or without a fibrous or fabric reinforcement component. Desirably, layer 13 is adhered to barrier layer 12 with a suitable adhesive material. If a solvent or plasticizer is present in barrier layer 12 or the adherent for adhering layer 13 to barrier layer 12 that would adversely affect the material from which insulation panels 14,14 are formed, the material from which layer 13 is formed should be impervious to such solvent or plasticizer in order to prevent the solvent from penetrating into panels 14,14.

Thermal insulation panels 14,14 may be formed of any closed-cell thermal insulation cellular material that is essentially water-impermeable and resistant to climatic conditions to which they will be exposed. Typical closed-cell thermal insulation materials which are particularly suitable for use in panels 14,14 are closed-cell plastic foams such as closed-cell polystyrene foams, phenolic foams, polyvinyl chloride foams, polyethylene foams, styrene/acrylonitrile copolymer foams, urethane foams and styrene/methyl methacrylate foams. The upper face of each panel 14,14 has grooves or channels 17,17 formed therein which permit water to drain from the crests or ridges 18,18 that exist between grooves 17,17 and permit moisture entrapped within panels 14,14 to evaporate more readily to the atmosphere, as will be explained in greater detail hereinafter. Panels 14,14 may be of any size that can be conveniently handled by the workmen installing the roof. For example, measuring 1 to 2 meters in length, ½ to 1½ meters in width and 3 to 10 centimeters thick are of a size that can be conveniently handled by most workmen, although panels of even larger dimensions often are desirable. The greater the thickness of panels 14,14, the greater the thermal insulation value of the panels. Therefore, in geographical areas where extreme cold or heat is experienced, panels with a thickness of 10 or more centimeters may be preferred. If desire, panels 14,14 may be a composite of two or more layers. Although panels 14,14 generally are closely-abutted with each other to provide optimum insulation, the panels 14,14 need not be so closely abutted so as to provide a water-tight seal between the panels 14,14. Panels 14,14 can be formed by any appropriate process, such as by extrusion or by forming in closed molds.

While the protective cover layer over panels 14,14 may be a layer of gravel or small stones or a single sheet of appropriate material to protect panels 14,14 from sunlight degradation, desirably the protective cover layer is comprised of a number of panels 15,15 positioned in side-by-side abutting relationship as shown. Panels 15,15 may be made of any suitable material that will effectively shield panels 14,14 against sunlight attack, such as panels of bituminous material reinforced, if desired, with fibers or one or more layers of felt or fabric, gypsum sheet, asphalt panels (which may include a protective silica coating), and the like. Panels 15,15 may be any convenient size, although panels approximately 1 to 2 meters in length, ½ to 1 meter in width, and 1 to 10 centimeters thick have been found to be most convenient. Panels 15,15, desirably, are in a closely-abutted relationship, but preferably are not sealed together to provide a watertight seal between adjacent panels 15,15 since it is desired that water be able to flow between panels 15,15, into grooves or channels 17,17 and be discharged into roof drains (not shown) normally installed in a roofing system. As is shown in FIG. 1, the abutting edges of panels 15,15 preferably are not positioned over the abutting edges of panels 14,14, but are offset therefrom.

Since winds blowing over a roof often creates updraft forces that have a tendency to lift and dislodge components of the roof construction, it is desirable to fasten panels 14,14 together by adhering abutting edges of panels 14,14 together with an appropriate adhesive or through use of mechanical fasteners (such as with metal or plastic clips 19 bridging across adjacent panels 14,14 or metal or plastic nails 20,20 driven through protective panels 15,15 and into panels 14,14).

Since moisture accummulations within a roofing system are objectionable, it is desirable that a condition be maintained that encourages moisture within a roofing system to move toward and be evaporated into the ambient exterior atmosphere. When the exterior atmosphere has a low moisture content, a differential in moisture concentration within the roofing system and in the exterior atmosphere favors the movement of moisture within the roofing system through the roofing system and into the exterior atmosphere. However, in prior roofing constructions using flat thermal insulation panels, during rainy weather or when snow or ice on the roof thaws, a film of water will be formed upon the upper surface of the insulation panels. The water layer will interfer with the desired movement of moisture through the roofing system and into the atmosphere since a condition of saturation will exist at the interface of the insulation panels with the film of water. An objectionable build-up of moisture within the roofing system then can occur. The grooves or channels 17,17 allow water to flow therein to the drainage system normally provided in roofing systems and allows the ridges or crests 18,18 of panels 14,14 to be free of a water layer covering. The desired movement of moisture through the roofing system and into the atmosphere, as a result, is realized through the movement of moisture at the interfaces of the ridges or crests 18,18 in the upper face of panels 14,14 preventing an objectionable build-up of moisture within the roofing system.

Although grooves or channels 17,17 are shown to extend generally parallel to each other, it will be appreciated that the grooves or channels 17,17 may intersect to form a grid pattern or diamond pattern or similar configuration and still obtain the desired result.

The embodiment of this invention shown in FIG. 4 illustrates a retrofitted built-up roofing system that includes thermal insulation panels installed over an existing roofing system. The existing roofing system is comprised of a base 25 (which may be a conventional roof base construction such as a steel deck supported on I-beams over which is placed a layer of fire-resistant material) and a layer 26 which as originally installed constituted a water-impermeable membrane such as would be formed by a laminate sheet composed of alternating layers of bituminous material and layers of felt or fabric. It will be understood that after prolonged exposure to the elements, layer 26 can become brittle due to loss of oils and other plasticizing materials originally present in the bituminous layers. When such weathering has occurred, layer 26 often will crack as a consequence of temperature fluctuations destroying the water-impermeability of layer 26. In order to restore the water-integrity of layer 26, before attempting to retrofit the weathered roof it is desirable to treat layer 26 with a waterproofing material to once again render layer 26 water-impermeable. The treatment usually will involve merely applying one or more coats of a bituminous sealing composition onto the weathered surface of layer 26. After layer 26 has been made waterproof once again, thermal insulation panels 28,28 are disposed in side-by-side abutting relationship over the existing roofing system with a protective barrier layer 29 interposed between the existing roofing system and insulation panels 28,28. The protective barrier layer 29 is intended to prevent panels 28,28 from becoming adhered to the existing roofing system (since the waterproofing coating applied to layer 26 to rejuvenate the water-integrity of layer 26 often remains tacky and would cause insulation panels 28,28 to stick to the coating) and to prevent any materials contained in the waterproofing coating that could be harmful to the material from which panels 28,28 are formed from migrating into panels 28,28. Barrier layer 29, then, can be any material which will produce the aforesaid intended results, such as a layer formed of polyvinyl chloride, chlorosulfonated polyethylene, polyehtylene, or the like. The thermal insulation panels 28,28 may be formed of any appropriate closed-cell thermal insulation material that is essentially water-impermeable and resistant to the climatic conditions to which the panels 28,28 are exposed. As indicated above, closed-cell polystyrene foam panels are particularly suitable and are quite economical. Panels 28,28 are provided with grooves or channels 31,31 in their upper faces which serve the same purposes as grooves or channels 17,17 in panels 14,14 of the roof construction 10 shown in FIG. 1. In addition, panels 28,28 are provided with grooves or channels 32,32 in their bottom faces. Grooves or channels 32,32 facilitate the drainage of water that may accummulate on the top face of barrier layer 29 and beneath panels 28,28 to help alleviate an excessive moisture build-up within the roofing system. Protective panels 35,35 are disposed in side-by-side abutting relationship over panels 28,28 to shield layers 28,28 from exposure to sunlight and to assist in holding panels 28,28 in place. Desirably, panels 28,28 are secured together in their respective side-by-side abutting relationship by mechanical fasteners 36,36. The protective panels 35,35 may be formed of any material that effectively shields panels 28,28 from sunlight. If protective panels 35,35 have sufficient weight that winds will not dislodge them, they need not be secured to panels 28,28. However, if desired, panels 35,35 may be mechanically fastened to themselves or to panels 28,28 with any suitable fastener. As shown, the abutting edges of panels 35,35 preferably are not positioned over the abutting edges of panels 28,28, but, instead, are offset therefrom.

If desired, peripheral ballast (such as concrete or stone panels) or peripheral mechanical securement around the peripheral areas of the roof system can be used to further increase the resistance of the roofing system to dislodgement due to winds blowing across the roof.

FIG. 5 illustrates yet another configuration of a thermal insulation panel 40 which can be used in the present invention. As shown, panel 40 has upper and lower faces having a wavy or sinuous surface rather than the angularly cornered grooves or channels depicted in FIGS. 1 and 4.

The invention is susceptible to various alterations and modifications and is not intended to be limited to the specific embodiments described above.

I claim:

1. A thermal insulated roof construction comprising a. a roof support means, b. a water-impermeable layer overlying said roof support means, c. a layer of thermal insulation overlying said water-impermeable layer and being unattached thereto throughout essentially its entire extent, said layer of thermal insulation being comprised of a plurality of panels position in side-by-side abutting relationship and having upper and bottom faces groves and ridges being formed in the upper faces facilitating water drainage from the ridges into the grooves, said panels being formed of a closed-cell cellular material and being essentially water-impermeable, and d. a water-permeable protective layer overlying in contacting relationship said layer of thermal insulation to shield said layer of thermal insulation from sunlight.

2. The thermal insulated roof construction of claim 1 wherein said panels which comprise said layer of thermal insulation have grooves and ridges in their bottom faces.

3. The thermal insulated roof construction of claims 1 or 2 wherein said panels which comprise said layer of thermal insulation are formed of closed-cell polystyrene foam.

4. The thermal insulated roof construction of claims 1 or 2 wherein adjacent panels of said panels which comprise said layer of thermal insulation are fastened together.

5. The thermal insulated roof construction of claims 1 or 2 wherein said protective layer overlying said layer of thermal insulation is comprised of a plurality of panels that are impervious to sunlight and are positioned in side-by-side abutting relationship.

6. The thermal insulated roof construction of claims 1 or 2 wherein said protective layer overlying said layer of thermal insulation is comprised of a plurality of panels that are impervious to sunlight and are positioned in side-by-side abutting relationship and wherein said panels which comprise said protective layer are attached to adjacent panels of thermal insulation which form said layer of thermal insulation.

7. The thermal insulated roof construction of claims 1 or 2 wherein said water-impermeable layer overlying said roof support means comprises a coating of waterproofing material over its upper face and wherein a barrier layer impervious to the transmission of components of said waterproofing material therethrough is interposed between said coating of waterproofing material and said layer of thermal insulation.

8. The thermal insulation roof construction of claims 1 or 2 wherein a layer of fire-retardant material is included within said roof support means.

9. The thermal insulation roof construction of claim 6 wherein said protective layer overlying said layer of thermal insulation is comprised of a plurality of panels that are impervious to sunlight and are positioned in side-by-side abutting relationship.

10. The thermal insulation roof construction of claim 6 wherein the abutments between said panels which comprise said layer of thermal insulation are offset from the abutments between said panels which comprise said protective layer that overlies said layer of thermal insulation.

11. The thermal insulation roof construction of claim 9 wherein said panels which comprise said protective layer are attached to adjacent thermal insulation panels which form said layer of thermal insulation.

* * * * *